US007077393B2

(12) United States Patent
Ishida

(10) Patent No.: US 7,077,393 B2
(45) Date of Patent: Jul. 18, 2006

(54) SHEET MEASURER AND FOLDER

(75) Inventor: Takeshi Ishida, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 185 days.

(21) Appl. No.: 10/799,597

(22) Filed: Mar. 15, 2004

(65) Prior Publication Data

US 2004/0178554 A1 Sep. 16, 2004

(30) Foreign Application Priority Data

Mar. 13, 2003 (JP) ..... 2003-067752

(51) Int. Cl.
*B65H 37/04* (2006.01)

(52) U.S. Cl. ..... 270/37; 270/32; 270/45; 270/58.08; 493/445; 493/444; 493/449

(58) Field of Classification Search ..... 270/32, 270/37, 39.06, 39.07, 39.08, 45; 493/444, 493/445, 449
See application file for complete search history.

(56) References Cited

U.S. PATENT DOCUMENTS 4,595,187 A * 6/1986 Bober ..... 270/37
5,364,332 A * 11/1994 Gray, Jr. ..... 493/23
6,834,853 B1 * 12/2004 Trovinger et al. ..... 271/227
6,929,256 B1 * 8/2005 Kawatsu et al. ..... 270/37

FOREIGN PATENT DOCUMENTS

JP 9-12211 1/1997
JP 2004277037 A * 10/2004

* cited by examiner

*Primary Examiner*—Patrick Mackey
(74) *Attorney, Agent, or Firm*—Morrison & Foerster LLP

(57) ABSTRACT

A finisher that is capable of accurate sheet processing but is small in size, the finisher controlling a feeder and a sheet folding unit and executing 1) an operation in which the sheet is conveyed in the first direction, and after a downstream edge thereof relative to the first direction is detected by the detector during conveyance, the sheet is conveyed in the second direction, 2) an operation in which after such sheet edge is detected by the detector during conveyance in the second direction, the conveyance of the sheet in the second direction is continued for a prescribed amount based on a sheet length along a direction of conveyance, whereupon the sheet is stopped, and 3) an operation in which after the sheet is stopped, the sheet folding unit is operated to create a fold line at a prescribed position in the sheet.

18 Claims, 10 Drawing Sheets

SHEET MEASURER AND FOLDER

This application is based on Japanese Patent Application No. 2003-67752 filed in Japan on Mar. 13, 2003, the entire content of which is hereby incorporated by reference.

BACKGROUND OF THE INVENTION

1. Field of the Invention

The present invention relates to a finisher used while connected to an image forming apparatus such as a copying machine, printer or multifunction peripheral (MFP) and the method of sheet processing performed by such finisher.

2. Description of the Related Art

As a second sheet processing apparatus (finisher) that is used in combination with a first sheet processing apparatus such as a copying machine, an apparatus has been proposed that accumulates sheets after creating a fold line in the center of each sheet supplied from the first sheet processing apparatus, and binds the sheets in the center (center-binding) by placing staples along the fold line (see Japanese Laid-Open Patent Application No. H9-12211, for example).

In this second sheet processing apparatus, a fold line is created in the sheet by a sheet folding unit that is disposed in the conveyance path while the leading edge (the first edge) of the sheet introduced into the apparatus is held in place using a regulator plate, the conveyance of the sheet is then reversed (i.e., the sheet is ejected from the sheet folding unit with the trailing edge (the second edge) advancing first), and the sheet is conveyed along a reverse path and ejected onto a tray. Multiple sheets are accumulated in this way to create a packet of sheets. After the grouped sheets are aligned along the first edge using a regulator plate, the packet is conveyed to the stapling position, at which staples are driven into the fold line.

Incidentally, sheets vary in size. For example, landscape-oriented A4-size sheets (here, the length of the sheet is perpendicular to the direction of conveyance) have a length falling within the range of 210±2 mm. Therefore, where each sheet is folded using the first edge as a reference point, and stapling is carried out using the second edge as a reference point, for example, the staples may be offset slightly from the fold line. In contrast, using the construction of the conventional apparatus described above, because folding and stapling are both performed after the sheet or packet of sheets is positioned using the first edge as a reference point, staples can be accurately driven into the fold line even if the sheets vary in size.

In the conventional art, the second sheet processing apparatus is generally installed next to the first sheet processing apparatus, which comprises a copying machine or the like, but in recent years, a compact image processing system is proposed that is composed of a first sheet processing apparatus and a second sheet processing apparatus, wherein at least part of the second sheet processing apparatus is disposed within the first sheet processing apparatus such that the space that would have been required for installation of the second sheet processing apparatus may be eliminated.

However, where the second sheet processing apparatus has a binding mode such as a center-binding mode in which a fold line is created in sheets and staples are driven into the fold line, the system inevitably becomes large in size because, as described in Japanese Laid-Open Patent Application No. H9-12211, for example, a reverse path or the like must be included in order to use the same edge of the sheet or packet of sheets as the reference point for the folding and stapling operations in the manner described above.

OBJECT AND SUMMARY

An object of the present invention is to provide an improved finisher that resolves the various problems identified above, as well as a sheet processing method implemented by such finisher.

Another object of the present invention is to provide a finisher that is capable of accurate sheet processing but is small in size, as well as a sheet processing method implemented by such finisher.

These and other objects are attained by providing a finisher that comprises, for example:

- a feeder that conveys a sheet in a first direction and a second direction that is the opposite direction from the first direction along a conveyance path;
- a detector that detects the sheet being conveyed;
- a sheet folding unit that creates a fold line in the sheet;
- a controller that controls the feeder and the sheet folding unit, and executes 1) an operation in which the sheet is conveyed in the first direction, and after the downstream edge thereof relative to the first direction is detected by the detector during conveyance, the sheet is conveyed in the second direction, 2) an operation in which after such sheet edge is detected by the detector during conveyance in the second direction, the conveyance of the sheet in the second direction is continued for a prescribed amount based on a sheet length along a direction of conveyance, whereupon the sheet is stopped, and 3) an operation in which after the sheet is stopped, the sheet folding unit is operated to create a fold line at a prescribed position in the sheet;
- a sheet accumulator that accumulates sheets in which the fold line has been created while aligning them by the edge to create a packet of sheets; and
- a stapler that places staples into the sheet packet formed by the sheet accumulator.

In the above finisher, it is acceptable if the prescribed amount is set such that a distance between the above sheet edge and the prescribed position at which a fold line should be created is half of the sheet length along the direction of conveyance.

These and other objects may also be attained by providing a finisher that comprises, for example:

- a feeder that conveys a sheet in a first direction and a second direction that is the opposite direction from the first direction along a conveyance path;
- a sheet folding unit that creates a fold line in the sheet;
- a controller that controls the feeder and the sheet folding unit and executes 1) an operation in which the sheet is conveyed in the first direction, and is then stopped when the downstream edge thereof relative to the first direction is at a prescribed position along the conveyance path, 2) an operation in which, after the sheet is stopped, the sheet is conveyed in the second direction by a prescribed amount based on the sheet length along a direction of conveyance and stopped, and 3) an operation in which, after the sheet is stopped for the second time, the sheet folding unit is operated to create a fold line at a prescribed position on the sheet;
- a sheet accumulator that accumulates sheets in which the fold line has been created while aligning them along the above edge to create a packet of sheets; and
- a stapler that places staples into the sheet packet formed by the sheet accumulator.

In the above finisher, it is acceptable if the prescribed amount is set such that a distance between the above sheet edge and the prescribed position at which a fold line should be created is half of the sheet length along the direction of conveyance.

These and other objects are also attained by providing a finisher that is composed of, for example:

- a feeder that conveys a sheet in a prescribed direction along a conveyance path;
- a measuring unit that measures a length of the sheet along a direction of conveyance;
- a detector that detects the sheet being conveyed;
- a sheet folding unit that creates a fold line in the sheet;
- a controller that controls the feeder and the sheet folding unit and executes 1) an operation in which the sheet is conveyed in the prescribed direction, and after an upstream edge thereof relative to the prescribed direction is detected by the detector, the conveyance of the sheet in the prescribed direction is continued for a prescribed amount based on the sheet length along the direction of conveyance, whereby the sheet is stopped, and 2) an operation in which, after the sheet is stopped, the sheet folding unit is operated to create a fold line at a prescribed position of the sheet;
- a sheet accumulator that accumulates sheets in which the fold line has been created while aligning them using an edge opposite from the above edge to create a packet of sheets; and
- a stapler that places staples into the sheet packet formed by the sheet accumulator.

In the above finisher, it is acceptable if the prescribed amount is set such that a distance between the edge opposite from the above sheet edge and the prescribed position at which a fold line should be created is half of the sheet length along the direction of conveyance.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1:
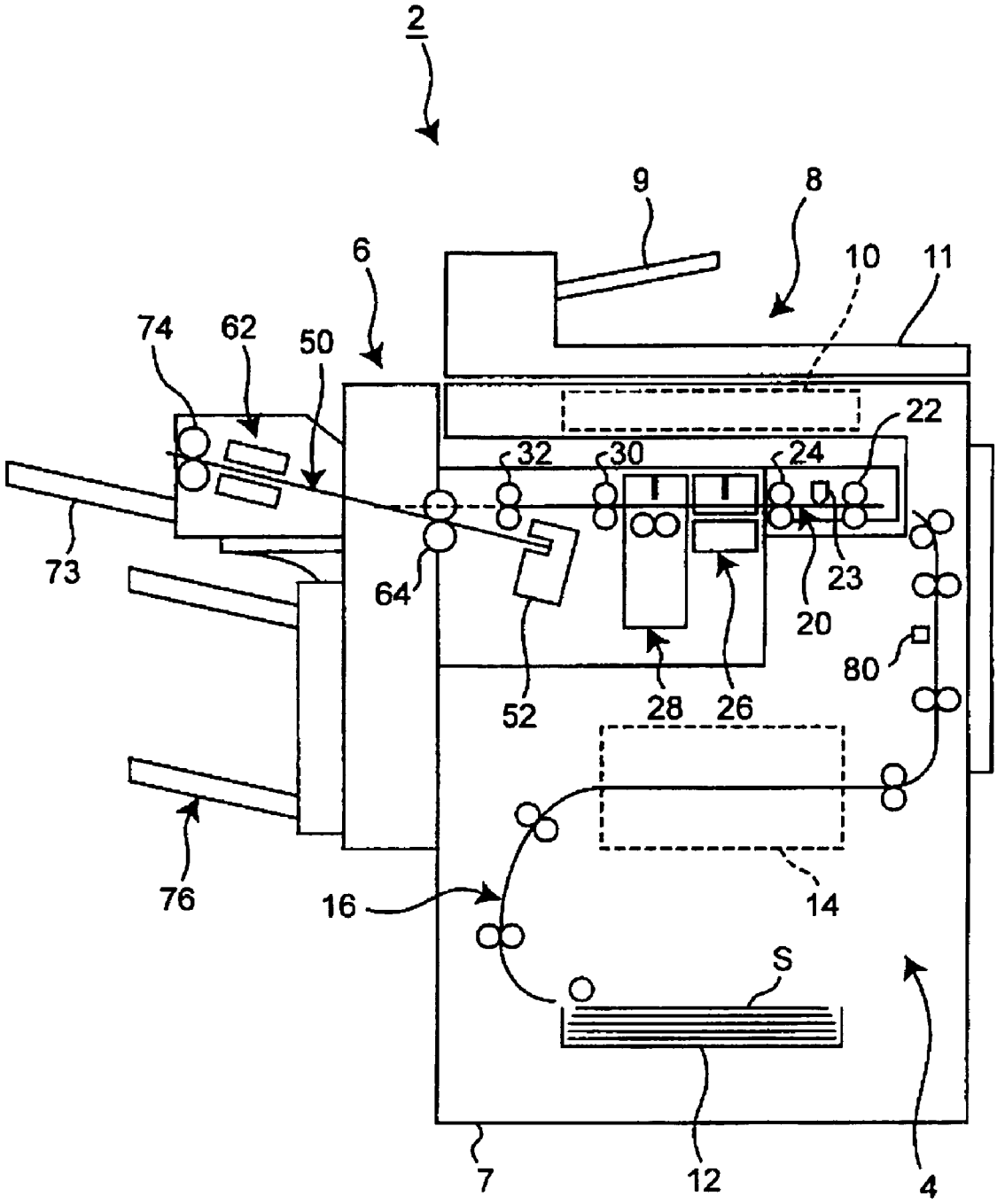
FIG. 1 shows the basic construction of an image processing system that includes a finisher comprising one embodiment of the finisher pertaining to the present invention.

The embodiments of the present invention are described below with reference to the attached drawings. In this Specification, terms that indicate a direction (such as 'up', 'down', 'right', and 'left', for example, and other terms including these terms) are used, but the direction only means the direction in the drawings used for the description of the embodiments, and the present invention should not be construed as limited in any way by these terms.

First Embodiment of Binding Method

FIG. 1 shows the entirety of an image processing system 2. This image processing system 2 has a first sheet processing apparatus (hereinafter 'first processor') 4 and a second sheet processing apparatus (hereinafter 'second processor') 6. In this embodiment, the first processor 4 comprises a copying machine that reproduces an original document image on a sheet, and includes an automatic document feeder 8 disposed in a housing 7 that comprises the outer view of the system 2, and an optical system 10 to read the original document conveyed from the original document supply tray 9 of the automatic document feeder 8 to the original document reading position (not shown). The original document scanned by the optical system 10 is ejected into an original document ejection tray 11 included in the automatic document feeder 8.

The first processor 4 also includes a paper supply tray 12 that is disposed in the bottom part of the housing 7 and on which sheets S are stacked, an image forming unit 14 that is disposed around the center of the housing 7 and outputs an image onto a sheet based on the image data obtained from reading of the original document, a conveyance system 16 that conveys the sheet from the paper supply tray 12 to the second processor 6 via the image forming unit 14, and the like.

The second processor 6 is a finisher that performs second processing regarding the sheet that has undergone first processing by the first processor 4, such as creation of a fold line at a prescribed area of the sheet and stapling of stacks of a prescribed number of sheets. In the example shown in the drawing, part of the second processor 6 is disposed between the optical system 10 and the image forming unit 14 of the first processor 4, and the other part protrudes from the left wall of the housing 7.

According to the image processing system 2 described above, prescribed first processing (such as image formation) is performed as to the sheet in the first processor 4. The sheet that has undergone this first processing is then supplied from the first processor 4 to the second processor 6, where the sheet is subjected to a fold line creation operation, stapling operation and other operations.

The construction of the second processor 6 is described below in detail with reference to FIGS. 2 and 3, as well as FIG. 1.

As shown in FIG. 1, the second processor 6 includes a first conveyance path 20 that extends straight from right to left within the housing. Along the first conveyance path 20, a pair of first conveyance rollers 22, a sensor 23, a pair of second conveyance rollers 24, a punch unit 26, a sheet folding unit 28, a pair of third conveyance rollers 30, and a pair of fourth conveyance rollers 32 are disposed sequentially from the upstream side toward the downstream side relative to the direction of sheet conveyance (i.e., the direction from right to left in the drawings, which may be referred to as the 'forward direction' below).

The first conveyance rollers 22 are disposed near the rightmost end of the first conveyance path 20, and receive the sheet ejected from the first processor 4 and convey it. The sensor 23 detects the sheet being carried along the first conveyance path 20. The punch unit 26 punches holes in the sheet at prescribed positions thereon (the construction of the punch unit 26 is not described herein). The sheet folding unit 28 creates a fold line at a prescribed area on the sheet. The fourth conveyance rollers 32 are disposed near the leftmost end of the first conveyance path 20.

Figure 2:
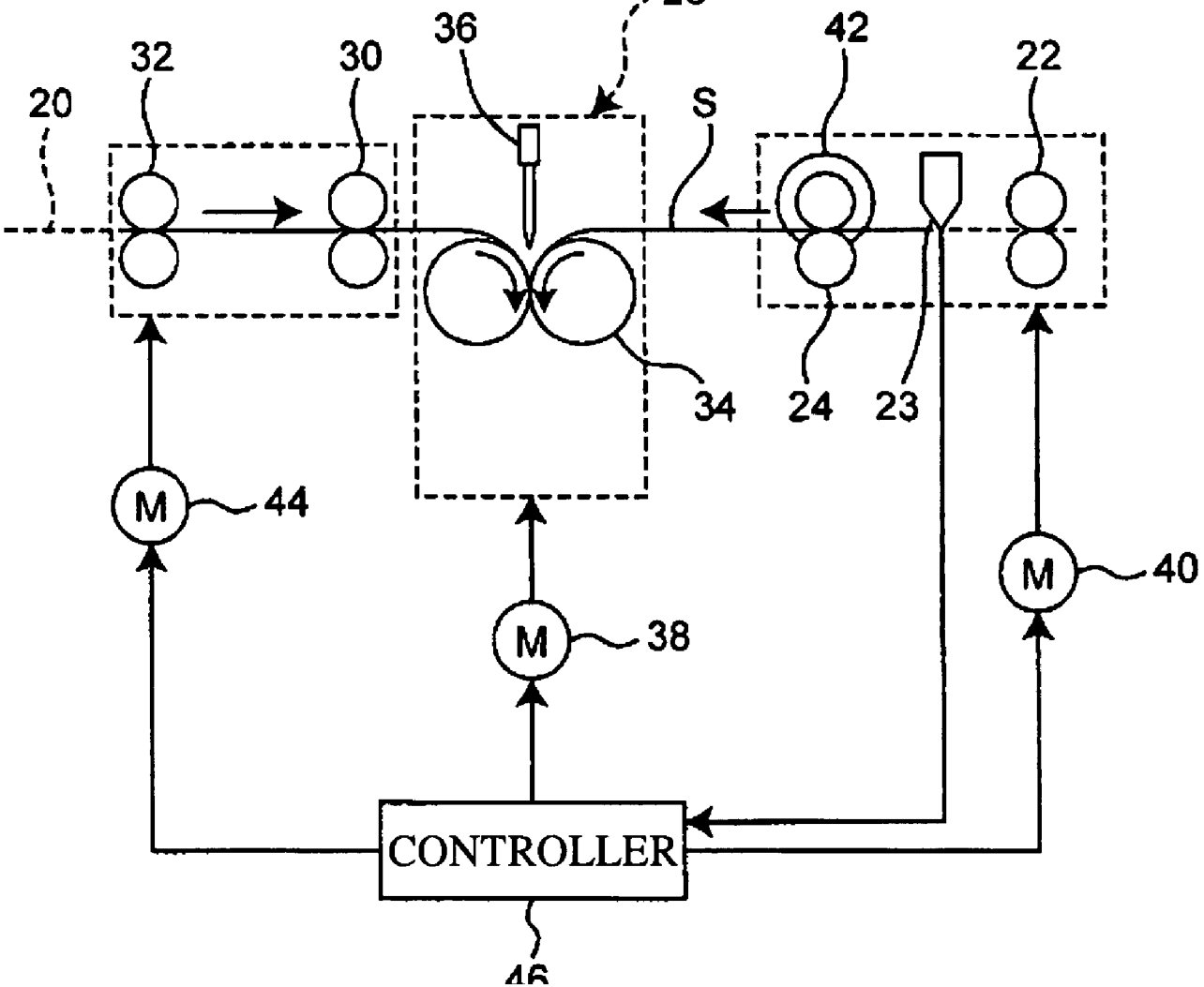
FIG. 2 is an enlarged view of a sheet folding unit and surrounding components in the finisher shown in FIG. 1.

As shown in detail in FIG. 2, the sheet folding unit 28 includes a pair of folding rollers 34 that can rotate forward or backward and that are disposed such that the line connecting the rotational axes thereof is parallel to and slightly lower than the first conveyance path 20, as well as a pusher member 36 the tip of which may be advanced in the direction perpendicular to the first conveyance path 20 toward the vicinity of the nipping area of the folding rollers 34. The folding rollers 34 and pusher member 36 are connected to the driving of a bidirectional motor 38.

In this embodiment, the first and second conveyance rollers 22 and 24 are connected to the driving of a bidirectional common motor 40. One of the second conveyance rollers 24 is connected to the motor 40 via a clutch 42, such that the second conveyance rollers 24 may be stopped while the motor 40 is being driven, permitting the sheet S to be guided to the sheet folding unit 28 after correction is made regarding the angling of the sheet by having the tip of the sheet come into contact with the nipping area of the second conveyance rollers 24.

In this embodiment, the third and fourth conveyance rollers 30 and 32 are connected to the driving of a bidirectional common motor 44.

The motor 38 is a DC motor that is controlled by a controller 46. The motors 40 and 44 are stepping motors, and rotate in a step-like fashion in accordance with pulses input from the controller 46. Detection signals from the sheet detection sensor 23 are also input to the controller 46. Furthermore, information regarding the specification sheet length L0 of the sheet that is subjected to second processing in the second processor 6 (for example, where a 210 mm×297 mm A4 sheet is conveyed such that the length of the sheet is parallel to the direction of conveyance, L0=297 mm) is sent from the first processor 4 to the controller 46 based on the user's instruction.

Returning to FIG. 1, a second conveyance path 50 that extends straight and downward in an angled fashion from left to right is disposed below and to the left of the fourth conveyance rollers 32. A regulator member 52, which is used to align the edges of multiple sheets ejected onto the second conveyance path (staple tray) 50 as described below, is disposed below and to the right of the fourth conveyance rollers 32 and at the rightmost end of the second conveyance path 50. As shown in detail in FIG. 3, a collating mechanism 54 is disposed above and close to the rightmost end of the second conveyance path 50, and comes into contact with the top surface of the sheets that fall from the first conveyance path 20 onto the second conveyance path 50 and conveys the sheets towards the regulator member 52 to reliably bring the edge of the sheets into contact with the regulator member 52. This collating mechanism 54 includes a continuous-loop belt 56 and rollers 58 and 60 that support the belt 56. When the driving roller 58 rotates in the direction of the arrow in the drawing, the driven roller 60 that is in contact with the sheet via the belt 56 rotates as indicated by the other arrow in the drawing, whereby the sheet is brought into contact with the regulator member 52. Where the packet of sheets S1, which are aligned a their edges, is conveyed upward in an angled fashion along the second conveyance path 50 from right to left (hereinafter referred to as the 'second forward direction'), as described below, the driven roller 60 is retracted from the position at which it comes into contact with the sheet.

A stapler 62 that drives staples into the fold line of the packet of sheets S1 to bind the packet is disposed at the leftmost end of the second conveyance path 50. Between the stapler 62 and the regulator member 52 are located a pair of fifth conveyance rollers 64 disposed such that they face each other across the second conveyance path 50 and convey the packet of sheets S1 along the conveyance path 50 in the second forward direction. The upper fifth conveyance roller 64 can be retracted from its position close to the second conveyance path 50 such that it does not interfere with sheets falling from the first conveyance path 20 onto the second conveyance path 50. The fifth conveyance rollers 64 are connected to the driving of a motor 66. The motor 66 is a stepping motor, and moves in a step-like fashion in accordance with pulses input from the controller 46.

The stapler 62 includes a head 68 that is disposed below the second conveyance path 50 and drives staples into the packets of sheets S1, as well as an anvil 70 that faces the head 68 and helps bind the packet of sheets S1 by bending the staples that have pierced the packet. The head 68 and anvil 70 can each move back and forth from positions at which they clamp the packet of sheets to positions separate from each other along a line perpendicular to the second conveyance path 50.

A pair of ejection rollers 74 that eject onto the ejection tray 73 the packet of sheets S1 that has been bound along its center line is disposed near the leftmost end of the second conveyance path 50. The upper ejection roller 74 can move in accordance with the thickness of the packet of sheets S1 while it presses down on the packet. The ejection rollers 74 are also used together with the fifth conveyance rollers 64 to convey the packet of sheets S1 along the second conveyance path 50 in order to set the packet at a prescribed position relative to the stapler 62.

Referring to FIG. 1, the tray 76 disposed such that it protrudes from the left wall of the housing 7 is used for the ejection of sheets or packets of sheets that have been subjected to the first or second processing by the image processing system 2 using a mode other than the center-binding mode.

The operation of the second processor 6 having the above construction while in the center-binding mode will now be explained with reference to FIGS. 4–7 as well as FIGS. 1–3.

First, in step S401, the sheet S that has undergone the first processing is guided into the second processor 6. The sheet S is conveyed along the first conveyance path 20 until the sheet detection sensor 23, which is disposed upstream from the sheet folding unit 28 relative to the first forward direction, detects the trailing end of the sheet (steps S402, S403) (see FIG. 6(*a*)). In step S404, the controller 46 causes the first through fourth conveyance rollers 22, 24, 30 and 32 to stop rotation in response to a signal from the sheet detection sensor 23. As shown in FIG. 6(*a*), the trailing edge of the sheet S has passed the detection position P1 of the sheet detection sensor 23. The controller 46 causes the first through fourth conveyance rollers 22, 24, 30 and 32 to rotate in the reverse direction such that the trailing edge of the sheet S passes the detection position P1 of the sheet detection sensor 23 (steps S405, S406) (see FIG. 6(*b*)), and after the sheet S has been conveyed in the direction opposite from the first forward direction by an amount L1 (step S407), the controller 46 stops the rotation of the first through fourth conveyance rollers 22, 24, 30 and 32 (step S408) (see FIG. 6(*c*)). The amount L1 by which the sheet S is conveyed in the reverse direction is calculated based on the specification sheet length L0 specified by the user via, for example, a display panel (not shown) included in the image processing system 2 and the distance L2 between the fold position P2 of the sheet folding unit 28 (i.e., the position on the first conveyance path 20 facing the nipping area of the folding rollers 34) and the detection position P1 of the sheet detection sensor 23 using the formula L1=L0/2−L2. This L1 is constant at all times regardless of variations in sheet size. The controller 46 inputs a prescribed number of pulses to the motors 40 and 44 based on the value of L1 to cause the first through fourth conveyance rollers 22, 24, 30 and 32 to rotate by a prescribed rotational angle to move the trailing edge of the sheet S to the right (i.e., in the reverse direction) by a prescribed amount L1. Alternatively, it is also acceptable if the rotational speed of the motors 40 and 44 is held constant during conveyance of the sheet S in the reverse direction, and the controller 46 controls the driving time of the motors 40 and 44 based on the value of L1, such that the trailing edge of the sheet is moved in the reverse direction by an amount L1.

As described above, in the fold line creation operation, the sheet is positioned using the trailing edge thereof as the reference point.

With regard to steps S404 and S405, if another sheet detection sensor is disposed upstream from the sheet detection sensor 23 such that the trailing edge of the sheet is detected by this detection sensor during conveyance in the first forward direction, the controller 46 can control the motors 40 and 44 in response to the detection signal from the upstream sensor and stop the sheet with the trailing edge of the sheet at the, detection position P1 of the sheet detection sensor 23.

The second processor 6 performs the fold line creation operation in step S409. Specifically, referring to FIGS. 2 and 6(*d*), with the sheet S positioned at a prescribed position (the area of the sheet located at a distance L0/2 away from the sheet trailing edge is set at the fold position P2), the controller 46 controls the motor 38 such that the pusher member 36 moves down toward the nipping area of the folding rollers 34 and the folding rollers 34 rotate in the directions of the arrows in the drawings. At the same time, the first through fourth conveyance rollers 22, 24, 30 and 32 are caused to rotate in the directions of the arrows in FIG. 6(*d*) with the sheet S in position. As a result, the sheet S is pushed by the pusher member 36 into the nipping area of the folding rollers 34 while it is grasped by the folding rollers 34, whereby a fold line is created in the sheet S.

Subsequently, the controller 46 controls the motor 38 to cause the folding rollers 34 to rotate in the reverse direction. At the same time, the controller 46 moves up the pusher member 36. Furthermore, the controller 46 causes the first through fourth conveyance rollers 22, 24,30 and 32 to rotate forward to convey the sheet in the first forward direction along the first conveyance path 20 and eject it into the second conveyance path 50 (step S410). When this happens, the upper fifth conveyance roller 64 is positioned away from the second conveyance path 50 (i.e., is located at the position shown by the dotted line in FIG. 3).

Figure 3:
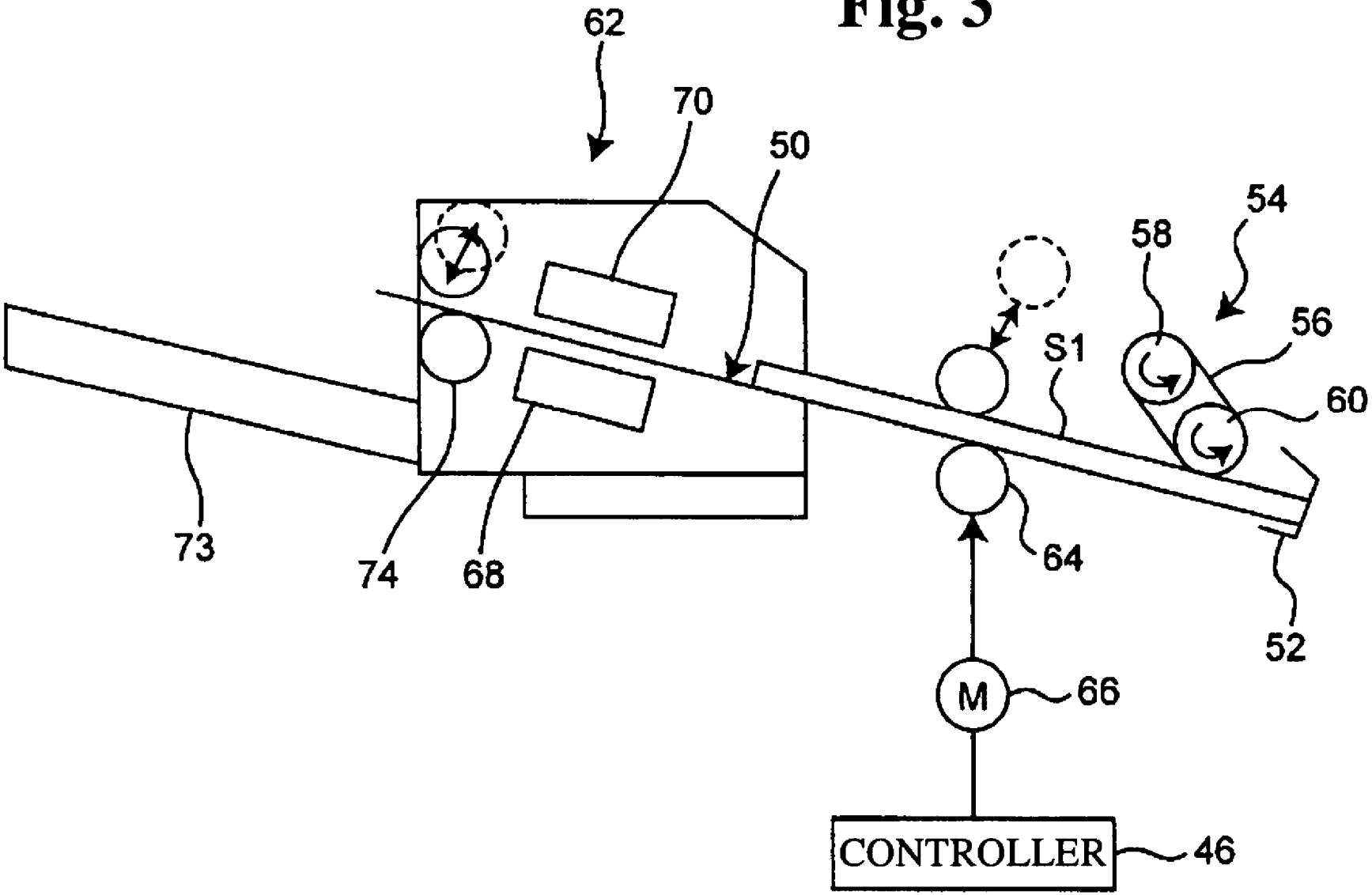
FIG. 3 is an enlarged view of a stapler and surrounding components in the finisher shown in FIG. 1.
Figure 4:
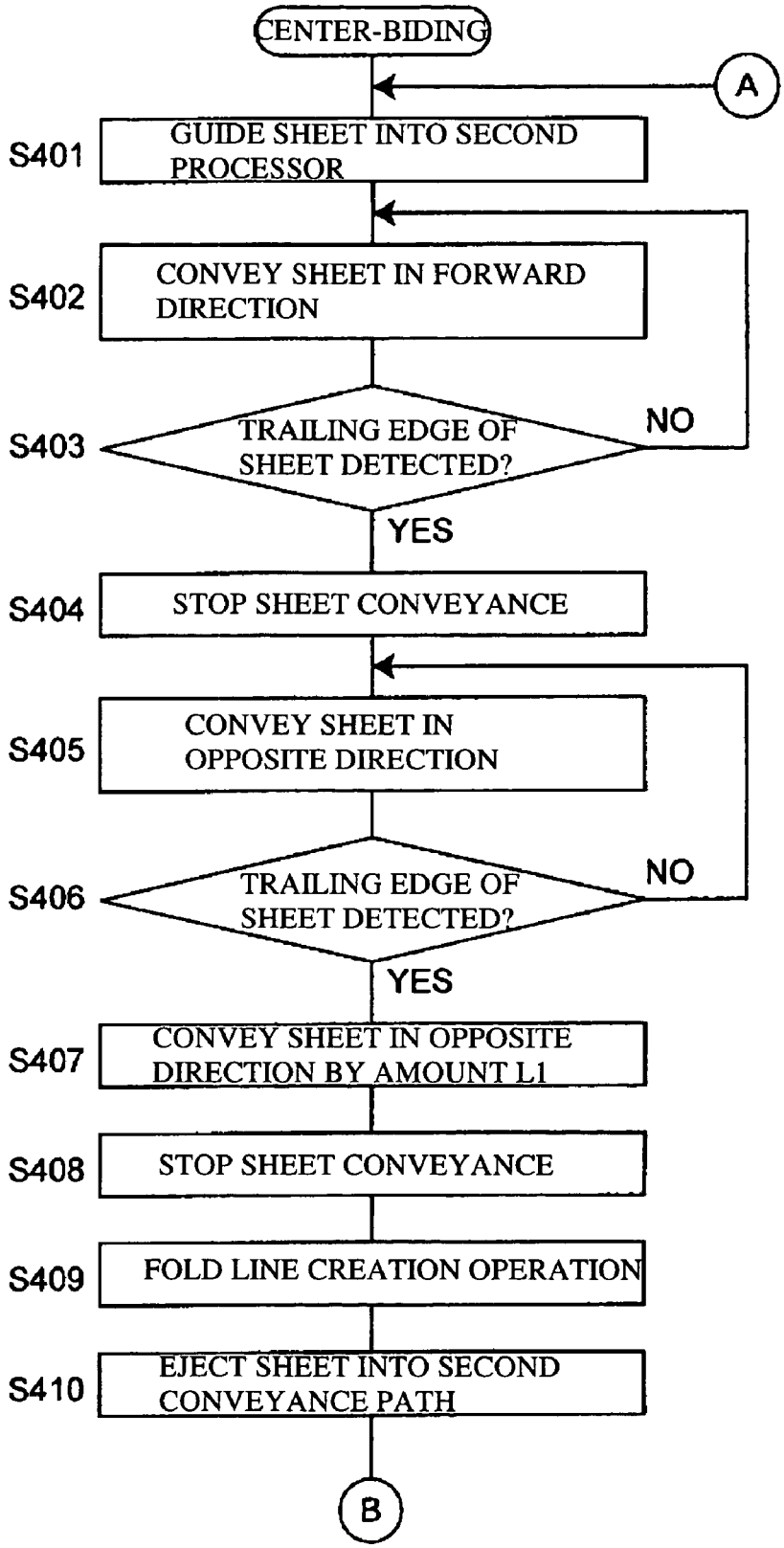
FIG. 4 is a flow chart showing a first section of a first embodiment of the binding method pertaining to the present invention.
Figure 5:
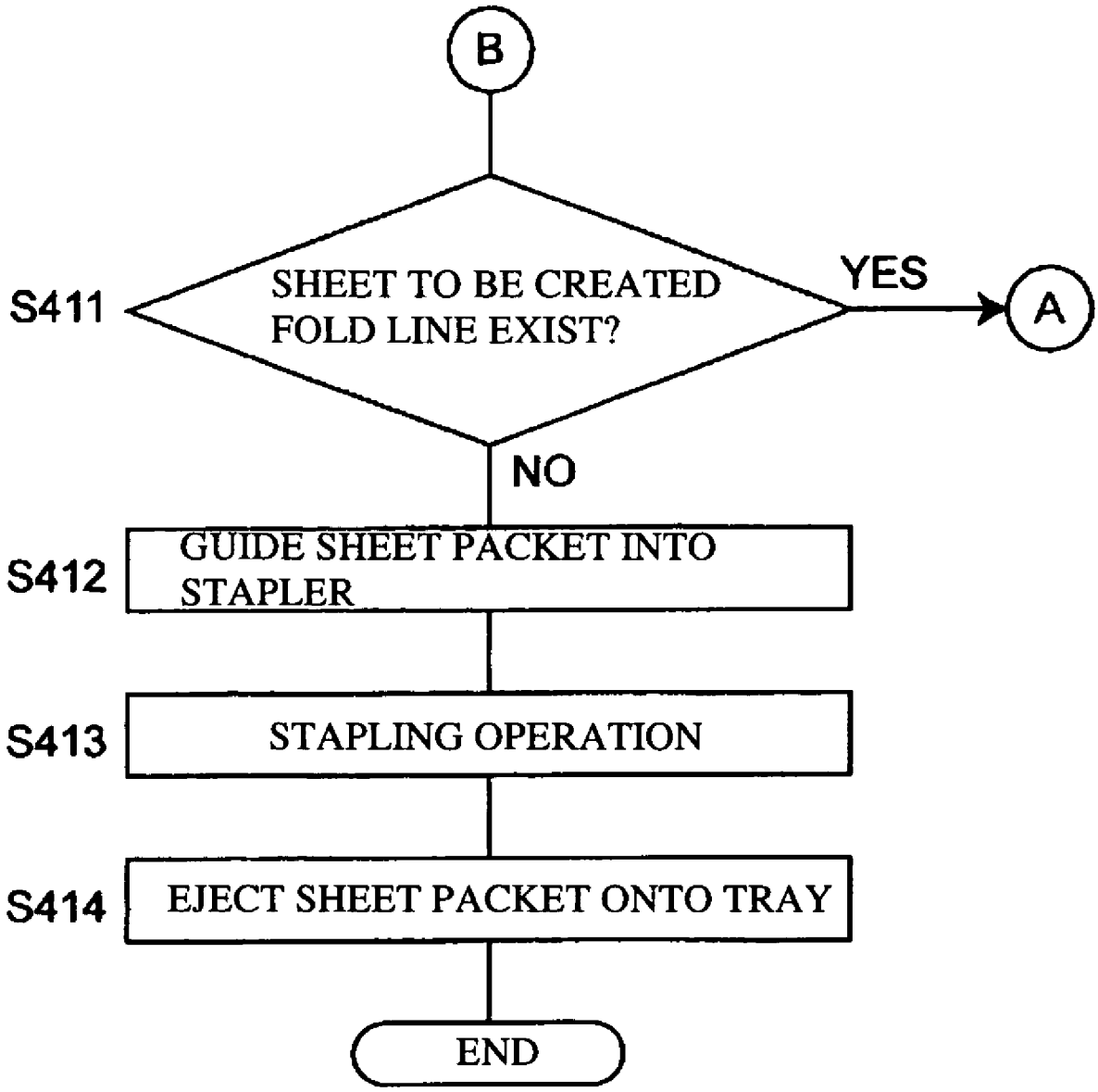
FIG. 5 is a flow chart showing a second section of the first embodiment of the binding method pertaining to the present invention.
Figure 6A:
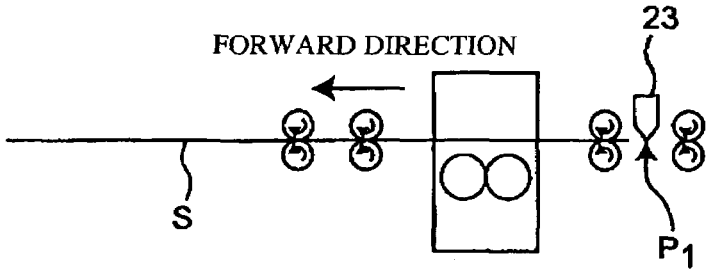
FIGS. 6*a*–6*d* show the processes of the sheet folding operation according to the first embodiment of the binding method pertaining to the present invention.
Figure 6B:
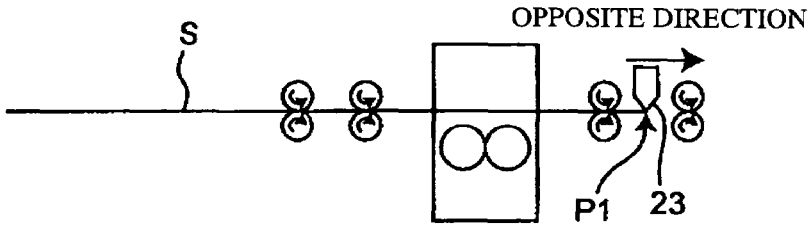
Figure 6C:
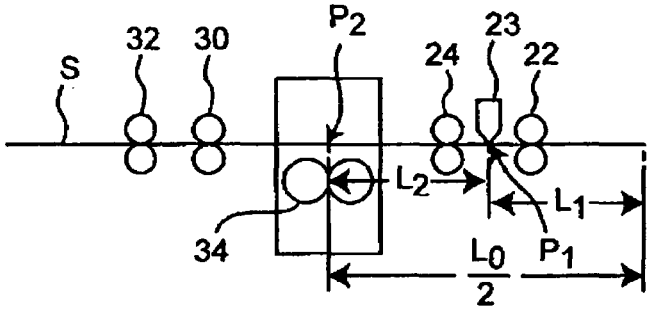
Figure 6D:
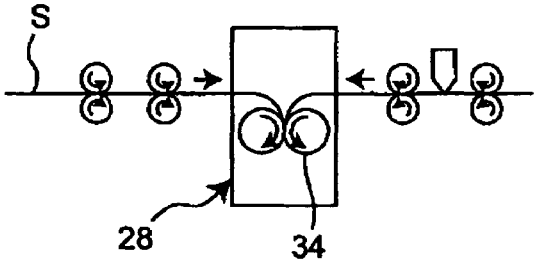
Figure 7A:
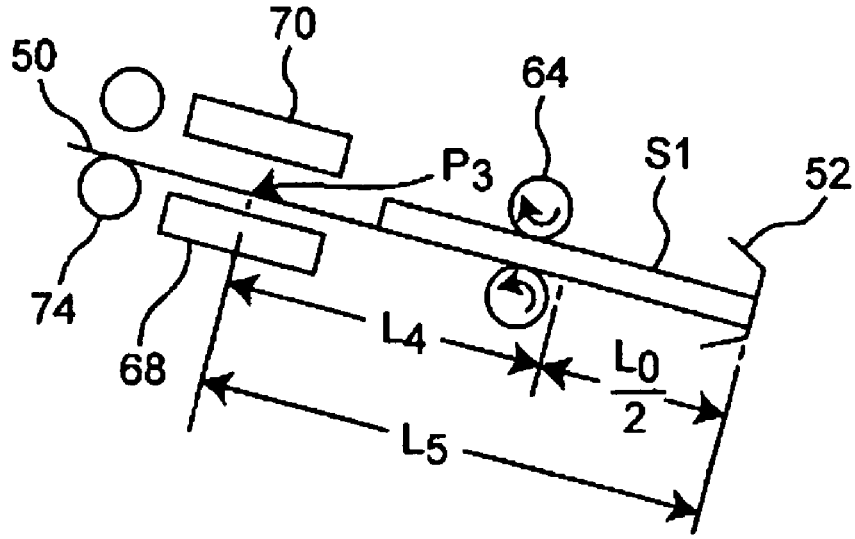
FIG. 7 shows the processes of the stapling operation according to the first embodiment of the binding method pertaining to the present invention.
Figure 7B:
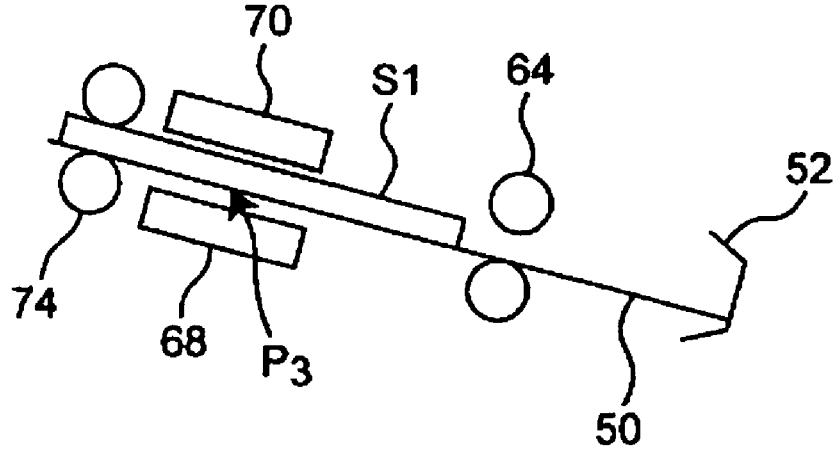

Referring mainly to FIG. 3, the first sheet that-has been ejected from the first conveyance path 20 via the fourth conveyance rollers 32 (see FIG. 1) is conveyed down by its own weight to the right along the second conveyance path 50, and stops at the position at which the leading edge thereof is in contact with the regulator member 52. The second sheet is then ejected into the second conveyance path 50, following the first processing, via the fourth conveyance rollers 32 after a fold line is created therein in the same manner as with the first sheet. The second sheet slides down at an angle to the right by its own weight over the first sheet. When this happens, the belt 56 of the collating mechanism 54 comes into contact with the top surface of the second sheet while rotating, and reliably moves the edge of the second sheet to the position of the regulator member 52, whereby the first sheet and the second sheet are collated. By repeating these operations, i.e., the operations of steps S401–S410, for the third sheet onward, a prescribed number of sheets becomes accumulated on the second conveyance path 50 (step S411) (see FIGS. 3 and 7(*a*)). The upper fifth conveyance roller 64 then becomes pressed onto the top surface of the packet of sheets S1. The controller 46 causes the fifth conveyance rollers 64 and/or the ejection rollers 74 to rotate, and after moving the trailing edge of the packet of sheets S1 in the second forward direction by a prescribed amount L4 such that the position of the fold line of the packet of sheets S1 matches the stapling position P3 of the stapler 62 (at which staples are driven), stops the rotation of the fifth conveyance rollers 64 and the ejection rollers 74 (step S412) (see FIG. 7(*b*)). This amount of conveyance L4 is calculated based on the distance L5 between the regulator member 52 and the stapling position P3 along the second conveyance path 50 and the specification sheet length L0 using the formula L4=L5−L0/2. L4 is constant at all times regardless of variations in sheet size. The controller 46 inputs a prescribed number of pulses to the motor 66 and/or the motor not shown that drives the ejection rollers 74 based on the value of L4 such that the fifth conveyance rollers 64 and/or ejection rollers 74 rotate by a prescribed rotational angle in order to move the trailing edge of the packet of sheets S1 by the prescribed amount L4 in the second forward direction. Alternatively, it is also acceptable if the rotational speed of the motor 66 and/or the motor that drives the ejection rollers 74 is held constant during conveyance of the packet of sheets S1 in the second forward direction, and the controller 46 controls based on the value of L4 the period of time during which these motors are driven such that the trailing edge of the packet of sheets S1 moves in the second forward direction by the amount L4.

In step S413, the head 68 and the anvil 70 of the stapler 62 are driven to bind the packet of sheets S1 by driving staples into the fold line in the approximate center thereof.

As described above, the stapling operation is performed with the packet of sheets positioned using the trailing edge thereof as a reference point. Therefore, because the sheet or the packet of sheets is positioned using the trailing edge both for the stapling and fold line creation operations, staples can be reliably driven into the fold line even if the sheet size varies.

Finally, in step S414, the ejection rollers 74 rotate and eject the center-bound packet of sheets onto the tray 73.

According to this embodiment, the specification sheet length L0 of the sheet being conveyed was obtained via user input, but it is also acceptable if the specification sheet length is calculated based on signals from the sheet detection sensor 23 and the number of pulses input to the motor 40. Specifically, the sheet detection sensor 23 detects the leading edge of the sheet being conveyed on the first conveyance path 20 in the first forward direction as well as the trailing edge thereof. (As described above, the conveyance of the sheet is stopped after the detection of the trailing edge.) The controller 46 can measure the actual length of the sheet by counting the number of pulses that are input to the motor 40 between the detection of the leading edge and the detection of the trailing edge. The specification sheet length L0 of the sheet being conveyed is then calculated based on this measured value and a predetermined threshold value. (As an example, where the measured value is within the threshold value range of 294 mm–300 mm, such as where the measurement value is 298 mm, for example, 297 mm, the length of A4 size paper, is adopted as the specification sheet length L0.)

Second Embodiment of Binding Method

Figure 8:
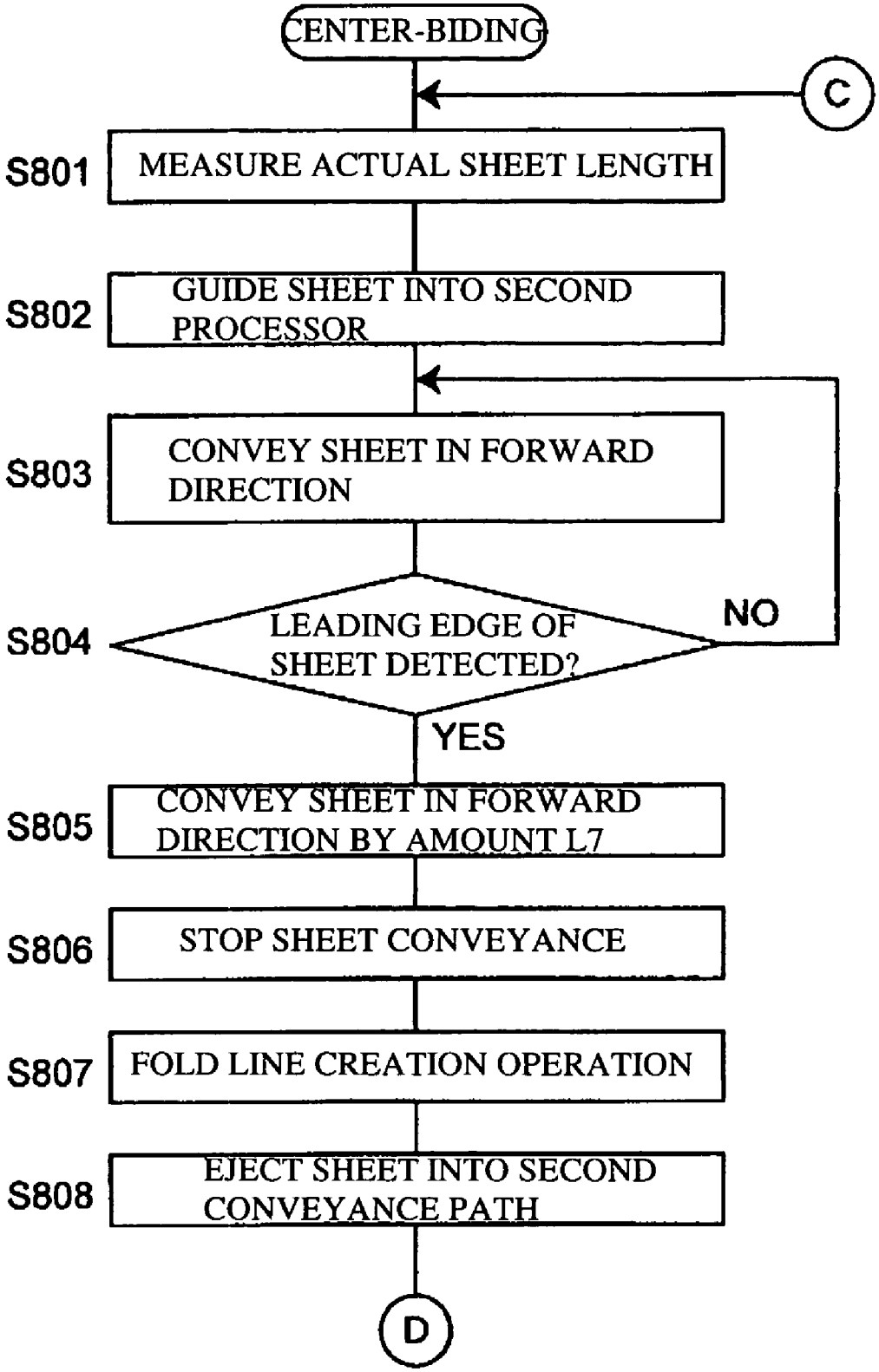
FIG. 8 is a flow chart showing a first section of a second embodiment of the binding method pertaining to the present invention.
Figure 9:
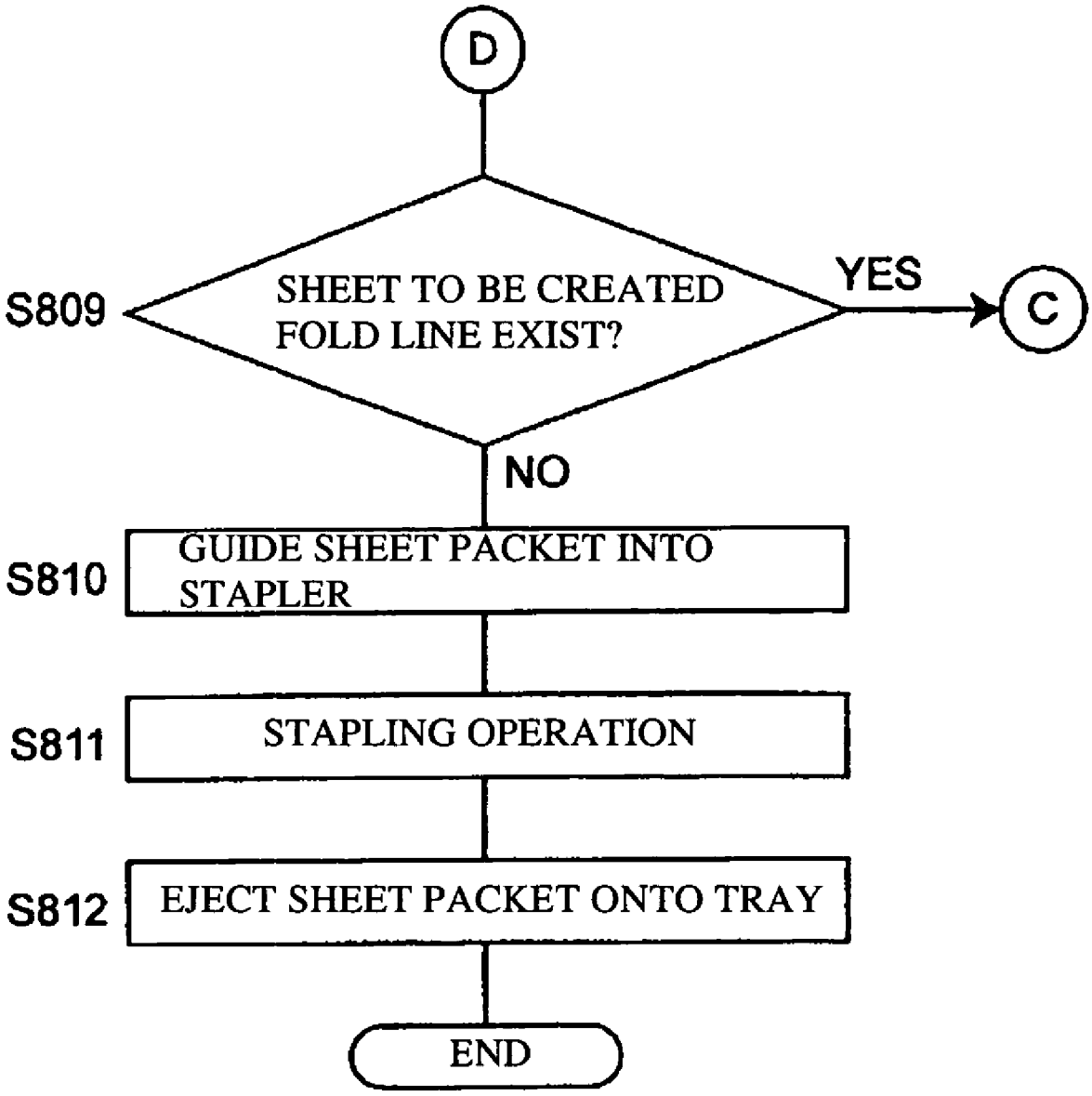
FIG. 9 is a flow chart showing a second section of the second embodiment of the binding method pertaining to the present invention.

A second embodiment of the binding method pertaining to the present invention will now be explained with reference to FIGS. 8–10. The construction of the second processor 6 that performs binding using this binding method is essentially identical to that shown in FIGS. 1–3 except as described below. Description is provided below with reference to FIGS. 1–3 as necessary.

According to this embodiment, first, the actual length of the sheet (i.e., the length along the direction of conveyance) is measured by the first processor 4 in advance (step S801). Specifically, a sheet detection sensor 80 is disposed at an appropriate position on the conveyance path of the conveyance system 16 (see FIG. 1) such that the sheet detection sensor 80 detects both the leading edge and the trailing edge of the sheet, and the sheet length L6 (such as 298 mm, for example) is measured by counting the number of pulses input to the stepping motor (not shown) that drives the conveyance rollers of the conveyance system 16 between the detection of the leading edge and the detection of the trailing edge.

The controller 46 (see FIG. 2) calculates the specification sheet length L0 of the sheet being conveyed based on the measured value L6 and a predetermined threshold value. (For example, where the measured value L6 falls within the threshold value range 294 mm–300 mm, 297 mm, the length of A4 size paper, is adopted as the specification sheet length L0.)

The sheet, which has undergone the first processing, is guided into the second processor 6, wherein it is conveyed along the first conveyance path 20 in the first forward direction (steps S802, S803).

Figure 10A:
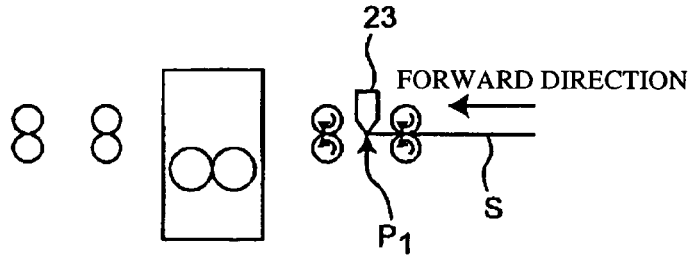
FIGS. 10–10*c* show the processes of the sheet folding operation according to the second embodiment of the binding method pertaining to the present invention.
Figure 10B:
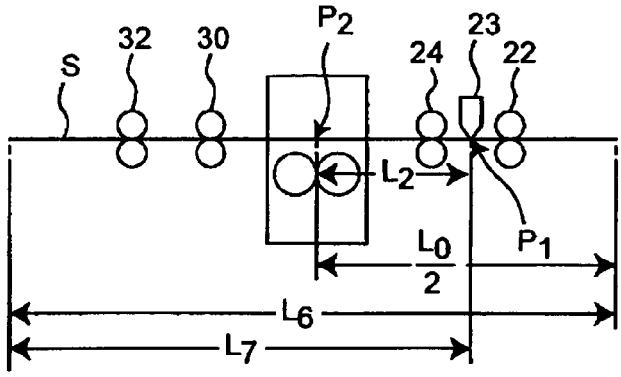
Figure 10C:
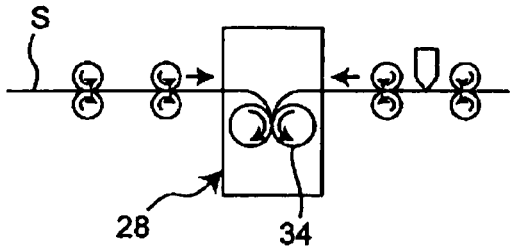

According to this embodiment, after the leading edge of the sheet S passes the detection position P1 of the sheet detection sensor 23 (step S804) (see FIG. 10(*a*)), the controller 46 causes the leading edge of the sheet S to be conveyed in the first forward direction by a distance L7=L6–L0/2+L2 from the detection position P1 such that the fold position P2 matches a position that is distanced from the trailing edge by a distance L0/2 (step S805), and stops the rotation of the first through fourth conveyance rollers 22, 24, 30 and 32 (step S806) (see FIG. 10(*b*)).

A fold line is then created in the sheet S by the sheet folding unit 28 in the same manner as described in connection with the first embodiment (step S807) (see FIG. 10(*c*)). According to this embodiment, the fold line creation operation is performed in this way with the trailing edge of the sheet as the reference point, and even if there are variations in the sheet size, a fold line is created at all times that is distanced from the trailing edge at a distance L0/2 in the first forward direction.

The sheet is then ejected onto the second conveyance path 50 (step S808) in the same manner as described in connection with the first embodiment. Multiple sheets are accumulated in the second conveyance path 50 with the trailing edge of each sheet in contact with the regulator member 52 by repeating the operations of steps S801–S808 with regard to a prescribed number of sheets (step S809) (see FIG. 3). The packet of sheets is then conveyed by a prescribed amount (equivalent to L4 in the first embodiment) to the stapling position of the stapler 62 using the fifth conveyance rollers 64 or the like (step S810), and staples are driven into the fold line (step S811).

As described above, the stapling operation is performed with the packet of sheets positioned using the trailing edge thereof as a reference point. Therefore, because the sheet or the packet of sheets is positioned using the trailing edge both for the stapling and fold line creation operations, staples can be reliably driven into the fold line even if the sheet size varies.

Finally, in step S812, the ejection rollers 74 rotate and eject the center-bound packet of sheets onto the tray 73.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

For example, a center-binding mode in which a fold line is created in the approximate center of the sheet was described with regard to the above embodiments, but the scope of the present invention also includes an embodiment in which a fold line is created at a different position of the sheet and staples are driven into such fold line.

In addition, in the stapling operation, the packet of sheets S1 was moved to the stapler 62 in the embodiments described above, but a construction may be used wherein the stapler 62 moves along the second conveyance path 50 toward the packet of sheets S1, or both the stapler 62 and the packet of sheets S1 move toward each other.

Furthermore, the sheet folding unit 28 is not limited to the construction described above with regard to the embodiments. For examples, according to the above embodiments, the folding rollers 34 rotate forward to create a fold line in the sheet, and then rotate backward to release the sheet S from the clamped condition, but if semicircular rollers having a configuration in which part of the circular section is removed are used as the folding rollers, the sheet can be clamped and then released while the semicircular rollers continue to rotate in the same direction.

In addition, according to the above embodiments, stepping motors were used as the motors 40, 44 and 66 that cause the first through fifth conveyance rollers 22, 24, 30, 32 and 64 to rotate and to stop, but servomotors such as motors with an encoder may be used instead.

As described in detail above, according to the second sheet processing apparatus (finisher) pertaining to the above embodiments, staples can be reliably driven into the fold line, regardless of variations in the sheet size, without the need for a reverse path. Accordingly, the second sheet processing apparatus, as well as the entire image processing system, can be made smaller in size.

What is claimed is:

1. A finisher comprising:

a feeder that conveys a sheet in a first direction and a second direction that is the opposite direction from the first direction along a conveyance path;

a detector that detects the sheet being conveyed;

a sheet folding unit that creates a fold line in the sheet;

a controller that controls the feeder and the sheet folding unit, and executes:

1) an operation in which the sheet is conveyed in the first direction, and after a downstream edge thereof relative to the first direction is detected by the detector during conveyance, the sheet is conveyed in the second direction, 2) an operation in which after such sheet edge is detected by the detector during conveyance in the second direction, the conveyance of the sheet in the second direction is continued for a prescribed amount based on a sheet length along a direction of conveyance, whereupon the sheet is stopped, and 3) an operation in which after the sheet is stopped, the sheet folding unit is operated to create a fold line at a prescribed position in the sheet;

a sheet accumulator that accumulates sheets in which the fold line has been created while aligning them by the edge to create a packet of sheets; and a stapler that places staples into the sheet packet formed by the sheet accumulator.

2. A finisher of claim 1, wherein the prescribed amount is set such that a distance between the above sheet edge and the prescribed position at which a fold line should be created is half of the sheet length along the direction of conveyance.

3. A finisher of claim 1, wherein the controller controls the feeder and the stapler such that the staples are placed into the fold line of the sheet packet.

4. A finisher comprising:

a feeder that conveys a sheet in a first direction and a second direction that is the opposite direction from the first direction along a conveyance path;

a sheet folding unit that creates a fold line in the sheet;

a controller that controls the feeder and the sheet folding unit and executes:

1) an operation in which the sheet is conveyed in the first direction, and is then stopped when a downstream edge thereof relative to the first direction is at a prescribed position along the conveyance path, 2) an operation in which, after the sheet is stopped, the sheet is conveyed in the second direction by a prescribed amount based on a sheet length along a direction of conveyance and stopped, and 3) an operation in which, after the sheet is stopped for the second time, the sheet folding unit is operated to create a fold line at a prescribed position on the sheet;

a sheet accumulator that accumulates sheets in which the fold line has been created while aligning them along the above edge to create a packet of sheets; and a stapler that places staples into the sheet packet formed by the sheet accumulator.

5. A finisher of claim 4, wherein the prescribed amount is set such that a distance between the above sheet edge and the prescribed position at which a fold line should be created is half of the sheet length along the direction of conveyance.

6. A finisher of claim 4, wherein the controller controls the feeder and the stapler such that the staples are placed into the fold line of the sheet packet.

7. A finisher comprising:

a feeder that conveys a sheet in a prescribed direction along a conveyance path;

a measuring unit that measures a length of the sheet along a direction of conveyance;

a detector that detects the sheet being conveyed;

a sheet folding unit that creates a fold line in the sheet;

a controller that controls the feeder and the sheet folding unit and executes:

1) an operation in which the sheet is conveyed in the prescribed direction, and after an upstream edge thereof relative to the prescribed direction is detected by the detector, the conveyance of the sheet in the prescribed direction is continued for a prescribed amount based on the sheet length along the direction of conveyance, whereupon the sheet is stopped, and 2) an operation in which, after the sheet is stopped, the sheet folding unit is operated to create a fold line at a prescribed position of the sheet;

a sheet accumulator that accumulates sheets in which the fold line has been created while aligning them using an edge opposite from the above edge to create a packet of sheets; and a stapler that places staples into the sheet packet formed by the sheet accumulator.

8. A finisher of claim 7, wherein the prescribed amount is set such that a distance between the edge opposite from the above sheet edge and the prescribed position at which a fold line should be created is half of the sheet length along the direction of conveyance.

9. A finisher of claim 7, wherein the controller controls the feeder and the stapler such that the staples are placed into the fold line of the sheet packet.

10. A sheet processing method comprising:

1) conveying a sheet in a first direction along a conveyance path;

2) detecting a downstream edge of the sheet relative to the first direction by a detector during sheet conveyance in the first direction;

3) conveying the sheet in a second direction opposite from the first direction after the downstream edge of the sheet is detected;

4) detecting the downstream edge of the sheet by the detector during sheet conveyance in the second direction;

5) continuing the sheet conveyance in the second direction for a prescribed amount based on a sheet length along a direction of conveyance after the downstream edge of the sheet is detected, whereupon the sheet is stopped;

6) creating a fold line at a prescribed position in the sheet after the sheet is stopped;

7) accumulating sheets in which the fold line has been created while aligning them by the edge to create a packet of sheets; and 8) placing staples into the sheet packet.

11. A sheet processing method of claim 10, wherein the prescribed amount is set such that a distance between the above sheet edge and the prescribed position at which a fold line should be created is half of the sheet length along the direction of conveyance.

12. A sheet processing method of claim 10, wherein the staples are placed into the fold line of the sheet packet.

13. A sheet processing method comprising:

1) conveying a sheet in a first direction along a conveyance path;

2) stopping the sheet when a downstream edge thereof relative to the first direction is at a prescribed position along the conveyance path, 3) after the sheet is stopped, conveying the sheet in a second direction opposite from the first direction by a prescribed amount based on a sheet length along a direction of conveyance and stopping the sheet;

4) after the sheet is stopped for the second time, creating a fold line at a prescribed position on the sheet;

5) accumulating sheets in which the fold line has been created while aligning them along the above edge to create a packet of sheets; and 6) placing staples into the sheet packet.

14. A sheet processing method of claim 13, wherein the prescribed amount is set such that a distance between the above sheet edge and the prescribed position at which a fold line should be created is half of the sheet length along the direction of conveyance.

15. A sheet processing method of claim 13, wherein the staples are placed into the fold line of the sheet packet.

16. A sheet processing method comprising:

1) conveying a sheet in a prescribed direction along a conveyance path;

2) detecting an upstream edge of the sheet relative to the prescribed direction;

3) continuing the conveyance of the sheet in the prescribed direction for a prescribed amount based on a sheet length along a direction of conveyance after the upstream edge of the sheet is detected, whereupon the sheet is stopped;

4) creating a fold line at a prescribed position of the sheet after the sheet is stopped;

5) accumulating sheets in which the fold line has been created while aligning them using an edge opposite from the above edge to create a packet of sheets; and 6) placing staples into the sheet packet formed by the sheet accumulator.

17. A sheet processing method of claim 16, wherein the prescribed amount is set such that a distance between the edge opposite from the above sheet edge and the prescribed position at which a fold line should be created is half of the sheet length along the direction of conveyance.

18. A sheet processing method of claim 16, wherein the staples are placed into the fold line of the sheet packet.

* * * * *